US012270399B2

(12) United States Patent
Seckinger et al.

(10) Patent No.: US 12,270,399 B2
(45) Date of Patent: Apr. 8, 2025

(54) COUPLING UNIT WITH CONNECTING PIECES

(71) Applicant: KSB SE & Co. KGaA, Frankenthal (DE)

(72) Inventors: Tobias Seckinger, Frankenthal (DE); Axel Schunk, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 64 days.

(21) Appl. No.: 18/032,124

(22) PCT Filed: Oct. 14, 2021

(86) PCT No.: PCT/EP2021/078396
§ 371 (c)(1),
(2) Date: Apr. 14, 2023

(87) PCT Pub. No.: WO2022/079144
PCT Pub. Date: Apr. 21, 2022

(65) Prior Publication Data

US 2023/0383755 A1 Nov. 30, 2023

(30) Foreign Application Priority Data

Oct. 16, 2020 (DE) ..... 10 2020 006 363.2
Oct. 13, 2021 (DE) ..... 10 2021 005 123.8

(51) Int. Cl.
*F04D 13/02* (2006.01)
*F04D 13/06* (2006.01)
(Continued)

(52) U.S. Cl.
CPC ..... *F04D 13/021* (2013.01); *F04D 13/06* (2013.01); *F04D 29/426* (2013.01); *F04D 29/5893* (2013.01); *F04D 29/628* (2013.01)

(58) Field of Classification Search
CPC .. F04D 13/021; F04D 29/426; F04D 29/4206; F04D 29/4226; F04D 29/42; F04D 29/628; F04B 53/16; H02K 5/04
See application file for complete search history.

(56) References Cited

U.S. PATENT DOCUMENTS 2,350,983 A 6/1944 Boyles et al.
5,624,245 A 4/1997 DeClerck et al.
(Continued)

FOREIGN PATENT DOCUMENTS

DE 10 2014 218 720 A1 3/2016
EP 1 038 611 A2 9/2000
(Continued)

OTHER PUBLICATIONS

Stracke, 'Coupling Housing for Fastening a Motor to a Pump'—Machine Translation of EP 1038611, Sep. 2000 (Year: 2000).*
(Continued)

*Primary Examiner* — Kenneth J Hansen
(74) *Attorney, Agent, or Firm* — Crowell & Moring LLP

(57) ABSTRACT

A pump assembly is provided with a coupling unit that connects a pump casing to a motor casing. The coupling unit has a pump-side connection part and a motor-side connection part. An annular element is arranged between the connection parts using supports which minimize heat transfer between the pump-side connection part and the motor-side connection part.

15 Claims, 5 Drawing Sheets

(51) Int. Cl.

| | |
|---|---|
| ***F04D 29/42*** | (2006.01) |
| ***F04D 29/58*** | (2006.01) |
| ***F04D 29/62*** | (2006.01) |

(56) References Cited

U.S. PATENT DOCUMENTS

| | | | | |
|---|---|---|---|---|
| 2009/0060763 | A1 | 3/2009 | Rush et al. | |
| 2016/0305445 | A1 | 10/2016 | Sorensen | |
| 2021/0396225 | A1* | 12/2021 | Tiganik | F04D 29/605 |

FOREIGN PATENT DOCUMENTS

| | | | |
|---|---|---|---|
| EP | 2 320 089 | A2 | 5/2011 |
| EP | 3 085 961 | A1 | 10/2016 |

OTHER PUBLICATIONS

International Search Report (PCT/ISA/210) issued in PCT Application No. PCT/EP2021/078396 dated Jan. 19, 2022 with English translation (five (5) pages).

German-language Written Opinion (PCT/ISA/237) issued in PCT Application No. PCT/EP2021/078396 dated Jan. 19, 2022 (seven (7) pages).

* cited by examiner

COUPLING UNIT WITH CONNECTING PIECES

CROSS REFERENCE TO RELATED APPLICATIONS

This application claims priority under 35 U.S.C. § 119 from German Patent Application No. 102020006363.2, filed Oct. 16, 2020, and from German Patent Application No. 102021005123.8, filed Oct. 13, 2021, the entire disclosures of which are herein expressly incorporated by reference.

BACKGROUND AND SUMMARY OF THE INVENTION

The invention relates to a pump arrangement having a coupling unit which connects a pump housing and a motor housing to each other, wherein the coupling unit has a pump-side connection component and a motor-side connection component.

Such a pump arrangement may, for example, be a centrifugal pump arrangement. Centrifugal pumps are based on the operating principle of energy transmission to a fluid by means of changing torsion as a result of a torque which is brought about by a constantly rotating impeller on the fluid flowing through it.

In most cases, centrifugal pumps are driven by means of electric motors. In addition to this electric drive, in centrifugal pump technology piston force machines are also used as a drive. In this instance, electric motors produce a constant torque. The electric motor is an electromechanical energy converter which converts electrical energy into mechanical energy. Depending on the form in which the electrical energy is available, direct-current motors, alternating-current motors or three-phase current motors are used. Generally, the electrical energy is converted into a rotational movement in this instance.

The electric motor which drives a centrifugal pump is in most cases connected to the pump with a specific spacing by means of a coupling unit. The coupling unit acts in this instance as a connection element between the motor and pump. In this case, the motor drive shaft extends centrally through openings in the two flanges or covers for securing to the motor and to the pump housing. Coupling units are generally produced by means of casting.

Such a coupling unit and a corresponding production method are, for example, described in EP 1 038 611 A2. The type of the connection enables a particularly stable embodiment of a coupling unit.

In pump arrangements which are used to convey fluids at high temperatures, a high thermal input from the pump housing in the direction toward the electric motor may occur. This can lead to several problems with the electric motor. High temperatures reduce the degree of efficiency of the energy conversion. The components of the motor, in particular the windings of the stator and the rotor, are thermally loaded, whereby the service-life thereof can be shortened.

The electric motor control may potentially reduce the power consumption and the speed in order to prevent overheating of the electric motor, whereby the pump can no longer operate in the desired operating range.

An object of the invention is to provide a coupling unit as a connection element between a pump housing and a drive motor. This coupling unit should conduct the heat which is emitted when conveying hot fluids from the pump housing in the direction toward the motor as little as possible. Furthermore, the coupling unit should be characterized by a compact construction type. The exchange of replacement components should be promoted by the construction of the coupling unit. The coupling unit should be able to be produced in a simple and cost-effective manner.

This object is achieved according to the invention by a pump arrangement having a coupling unit. Preferred variants can be derived from the dependent claims, the description and the drawings.

According to the invention, an annular element is suspended between the connection components by means of retention members.

The connection components may be in the form of a pump-side or motor-side connection flange. In a particularly compact embodiment of the invention, the pump-side connection component is in the form of a bearing carrier cover of the pump and the motor-side connection component is in the form of a cover of the motor block.

The annular element is preferably in the form of a sleeve which is connected to the connection components by means of the retention members. Advantageously, the coupling unit is thereby configured in a particularly compact and space-saving manner. In this instance, the retention members are, on the one hand, structurally reinforced in order to also be able to carry and retain the mass of the motor block and, on the other hand, configured in the smallest manner possible in order to reduce the thermal conduction from the pump housing in the direction of the motor housing to the greatest possible extent.

A retention member is a securing element which fixes the annular element to the connection component and at the same time a connection element which connects the annular element to the motor and pump housing or a connection flange.

In an advantageous variant of the invention, the retention members are constructed in a strut-like manner. The retention members thereby direct the forces transmitted from the motor housing or from the motor block via the pump housing into the base of the pump.

The retention members form a rigid suspension of the annular element and at the same time almost completely decouple the thermal conduction from the pump housing in the direction of the motor, and consequently allow where applicable the use of materials with a higher level of thermal conductivity.

In a particularly advantageous variant of the invention, the retention members extend from the edge of a connection component in each case as far as an inner ring, in particular an annular sleeve which acts, for example, as a bearing carrier for receiving a radial bearing for the pump shaft. The bearing carrier sleeve is thereby stabilized in a particularly advantageous manner and the component coupling unit is constructed in an efficient manner so as to be reduced to the required features.

The coupling unit is preferably constructed in an integral manner so that the connection components, the retention members and the annular element form a component which is preferably in the form of a cast component. In a particularly advantageous variant, the coupling unit is in the form of an aluminum die-cast component.

The retention members ideally protrude from the connection components radially inward and retain the annular element. In this instance, the annular element is arranged inside the base face of at least one connection element. As a result of the reduction of its proportions, produced by the inwardly protruding formation, the annular element has a smaller cross sectional surface-area, whereby the thermal conduction from the pump housing in the direction of the motor is reduced.

The retention member in the form of a strut is a structural element which primarily serves to discharge tensile and pressure forces brought about by the mass of the motor. The radially inwardly orientated form of the retention members promotes the discharge of the forces.

In an advantageous variant of the invention, the retention members are in the form of webs. Webs facilitate the spacing by forming a distance between the connection component and the annular element, whereby the thermal conduction from the pump housing in the direction toward the motor is decoupled in an extremely advantageous manner.

Advantageously, the retention members extend from the connection components radially inward to the annular element, whereby the spacing and decoupling with regard to the thermal conduction of the pump housing to the motor are promoted.

Advantageously, the connection of the annular element and the connection components may in addition be constructed in a reinforced manner with at least one stabilization element. In this instance, the cross sectional surface-area of a stabilization element is configured to be particularly small, wherein, as a result of the correct positioning also of a stabilization element with a small cross section, a high degree of reinforcement is achieved. The suspension of the annular element is thereby configured in a particularly stable manner, whilst the thermal conduction from the pump housing in the direction toward the motor is virtually decoupled.

In a particularly advantageous variant of the invention, the retention members are arranged at the pump-side connection component in a manner offset relative to the retention members at the motor-side connection component. In addition to the decoupling by the retention members, the path for the thermal conduction through the retention elements is also thereby extended, whereby the thermal conduction from the pump housing in the direction of the motor housing is additionally reduced.

The cross sectional surface-area of the retention members is significantly reduced in comparison with the cross sectional surface-area of the annular element for reducing the thermal conduction. In a particularly advantageous variant of the invention, the smallest cross sectional surface-area of a radial section is constructed in the connection region of the retention members to be more than 70%, preferably more than 80%, in particular more than 90% smaller than the cross sectional surface-area of the end faces of the annular element. As a result of the specific construction of the coupling unit, in particular of the retention members, the thermal conduction in the direction of the motor is advantageously decoupled.

Preferably, a radial section in the connection region of the retention members means that at the same time stabilization elements which are also present are sectioned and form a proportion at the cross sectional surface-area in the connection region of the retention members. Ideally, the sum of the cross sectional surface-area of the retention members and the cross sectional surface-area of the stabilization elements of a radial section in the connection region of the retention members is constructed to be more than 65%, preferably more than 75%, in particular more than 85% smaller than the cross sectional surface-area of the end faces of the annular element.

In order to reduce the thermal conduction within the annular element, the annular element has additional material recesses which are preferably constructed in an aperture-like manner. To this end, the annular element has at least one aperture-like material recess. In a particularly advantageous variant of the invention, the annular element has at least four aperture-like material recesses. The cross sectional surface-area of the annular element is thereby significantly reduced, whereby the thermal conduction from the pump housing in the direction toward the motor is significantly reduced.

The aperture-like material recesses not only lead to a reduced cross sectional surface-area, but also at the same time extend the path of the thermal conduction through the existing cross sectional surface-area of the annular element.

In an advantageous variant of the invention, the annular element has at least one formation which serves to reinforce the coupling unit. Motors with a relatively significant mass can thereby also be suspended on the coupling unit. Preferably, the annular element has two, preferably three, in particular four reinforcements.

The number of retention members on which the annular element is suspended can, on the one hand, in order to form an adequate load-bearing capacity be adapted to the mass of the electric motor and, on the other hand, in order to reduce the thermal conduction be adapted to the temperatures of the centrifugal pump. In a particularly advantageous variant of the invention, the annular element is suspended on precisely three retention members on a connection component in each case.

In an advantageous variant of the invention, the annular element has four retention members on a connection component in each case. As a result of the strut-like retention members, the annular element is suspended in a particularly stable manner with at the same time a minimal cross section of the retention members, whereby the thermal conduction from the pump housing in the direction toward the motor is reduced.

In another variant of the invention, the annular element is suspended at each end by means of five or six or seven or eight retention members.

Advantageously, the suspension of the annular element can be reinforced using stabilization elements. In an advantageous variant, the annular element is reinforced with four stabilization elements in each case on a connection component.

Preferably, the annular element has on each connection component more than two, in particular more than three, and/or less than six, in particular less than five stabilization elements.

In a particularly advantageous variant of the invention, a stabilization element is centrally arranged between two retention members, whereby the suspension of the annular element is carried out in a particularly robust and efficient manner.

Ideally, four retention members are arranged in a manner offset through 90° in each case, whilst an additional four stabilization elements are also arranged in a manner offset through 90° with respect to each other. In a particularly advantageous variant of the invention, the stabilization elements are positioned in this instance in a manner offset through 45° with respect to the retention members.

In a particularly advantageous variant of the invention, the coupling unit connects the pump housing and the motor housing directly. The pump arrangement is thereby configured in a very compact manner and so as to be reduced to the necessary components.

The coupling unit is preferably constructed in a cylindrical and/or trumpet-funnel-like manner. This spatial construction is particularly advantageous in order to achieve an additional cooling of the coupling unit by the cool air flow which is produced by the motor fan and which flows over the coupling unit. In an alternative variant of the invention, the coupling unit may also be constructed in a conical and/or parallelepipedal form and/or as a member having a polygonal base face.

In a variant of the invention, the coupling unit is constructed integrally with the motor-side pressure cover of the pump housing and/or integrally with the pump-side motor cover. Advantageously, the coupling unit can consequently be configured in a particularly compact manner and enables a pump arrangement with dimensions which can also be used at installation locations with limited spatial relationships.

The coupling unit is preferably constructed at the pump side and/or motor side as a bearing carrier. This leads to a particularly compact construction type of the coupling unit and at the same time to the reduction of the assembly complexity by reducing the number of components.

The coupling unit according to the invention is characterized by a compact, axial construction type in which the thermal conduction from the pump housing in the direction of the motor housing is decoupled by means of spacing using retention members. At the same time, the coupling unit as an integral component is advantageous to produce and advantageous with regard to the assembly.

Other objects, advantages and novel features of the present invention will become apparent from the following detailed description of one or more preferred embodiments when considered in conjunction with the accompanying drawings.

DETAILED DESCRIPTION

Figure 1:
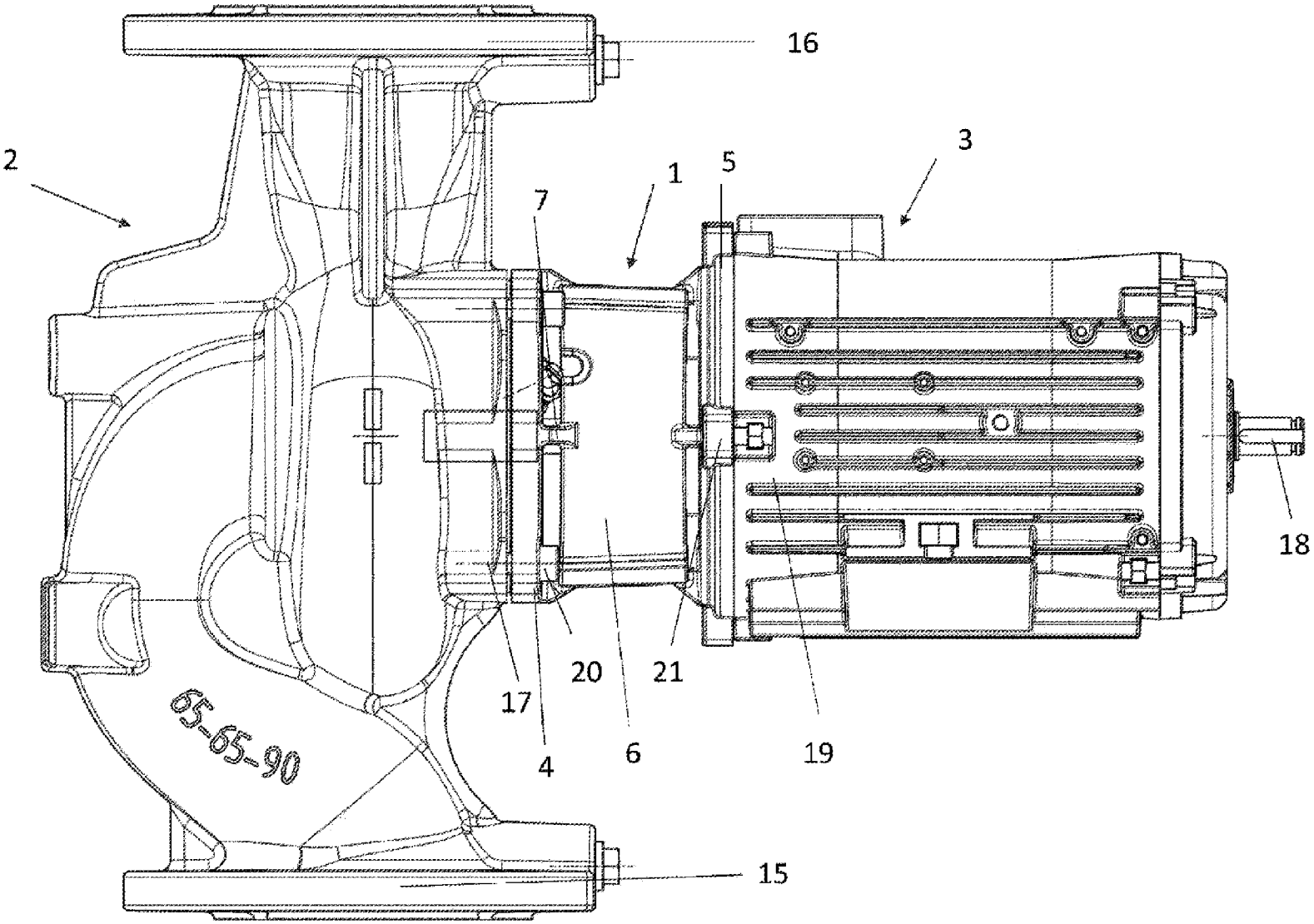
FIG. 1 shows a side view of a pump arrangement in accordance with an embodiment of the present invention.

FIG. 1 shows a pump arrangement having a coupling unit 1 which connects a pump housing 2 and a motor housing 3 to each other. The centrifugal pump illustrated in the embodiment is used to convey fluids which depending on the area of application may have high temperatures.

The fluid enters the pump housing 2 of the centrifugal pump through a suction nozzle 15. An impeller which is not illustrated is arranged inside the pump housing 2. The impeller transmits kinetic energy to the fluid which leaves the centrifugal pump via the pressure nozzle 16. The space which is filled with fluid and the impeller is delimited by a pump housing 2 and a housing cover 17. The impeller is connected in a rotationally secure manner to a pump shaft 18 which drives the impeller by means of a motor arrangement.

The coupling unit 1 is fixed to the pump housing 2 by means of four connection elements 20. In this variant, the connection component 5 is configured integrally as a motor cover and fixed to the motor housing 3 by means of the connection elements 21. The coupling unit 1 is configured in a very compact manner, wherein the annular element 6 is suspended on the connection components 4, 5 by means of the retention members 7.

Figure 2:
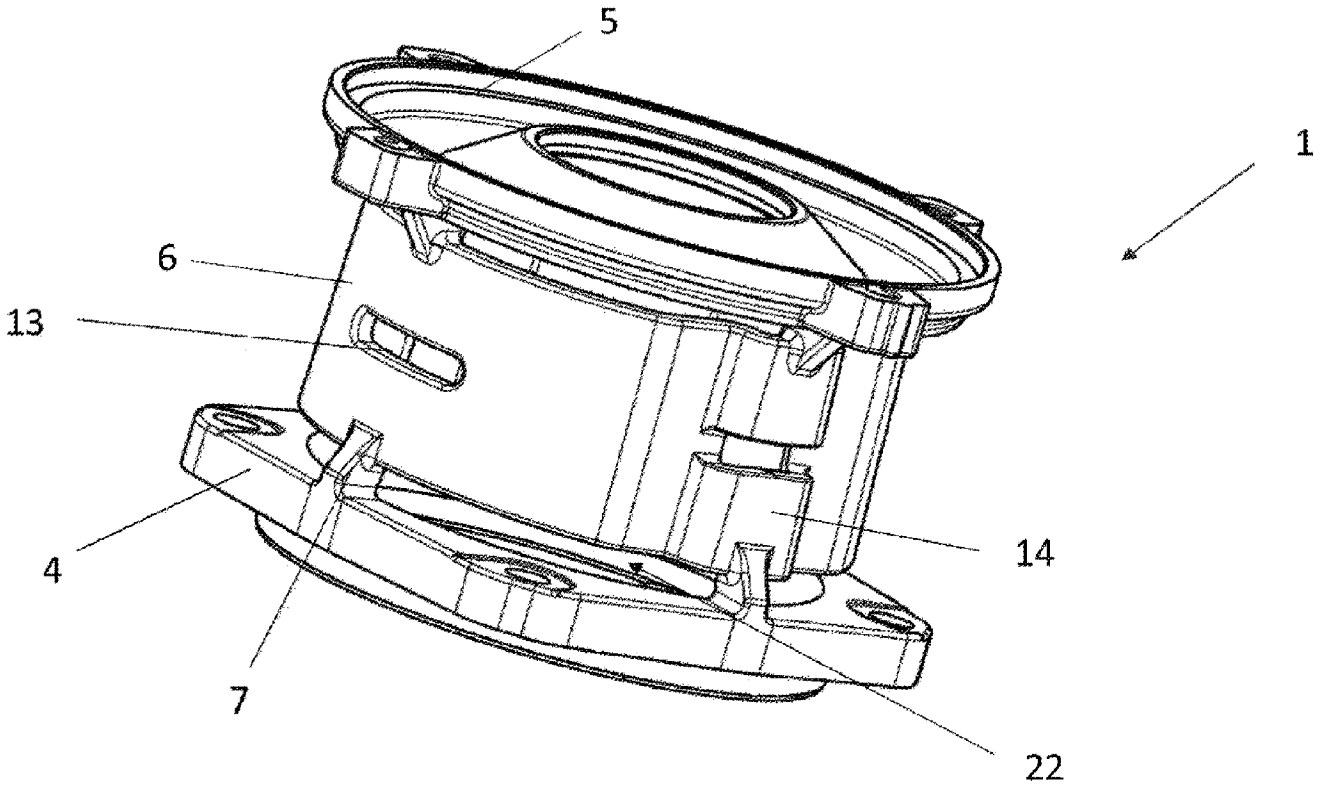
FIG. 2 shows a perspective illustration of the coupling unit of FIG. 1.

FIG. 2 shows a perspective illustration of the coupling unit 1. The annular element 6 is suspended on the connection components 4 and 5 by means of four retention members 7 in each case. The retention members 7 are constructed in the manner of struts and are thereby also capable of being able to securely suspend the mass of a motor construction which is intended to be supported. To this end, the annular element 6 is reinforced in the embodiment shown by two formations 14. At the same time, the retention members 7 are orientated radially inwardly and configured to be as small as possible in order to introduce a thermal conduction from the hot pump housing 2 into the motor housing 3 as little as possible. In order to minimize the thermal conduction, the annular element 6 has in this variant four aperture-like material recesses 13. The coupling unit 1 is constructed in an integral manner from an aluminum pressure die-casting.

The parallelepipedal connection element 4 is constructed with rounded corners, wherein the retention members 7 begin in each case centrally and extend radially inward in the manner of a strut. The annular element 6 thereby has a significantly smaller cross sectional surface-area than the connection component 4. The annular element 6 is consequently arranged within the base face of the connection element 4 with a reduced cross sectional surface-area, whereby the thermal conduction in the direction of the motor housing 3 is significantly reduced.

Figure 3:
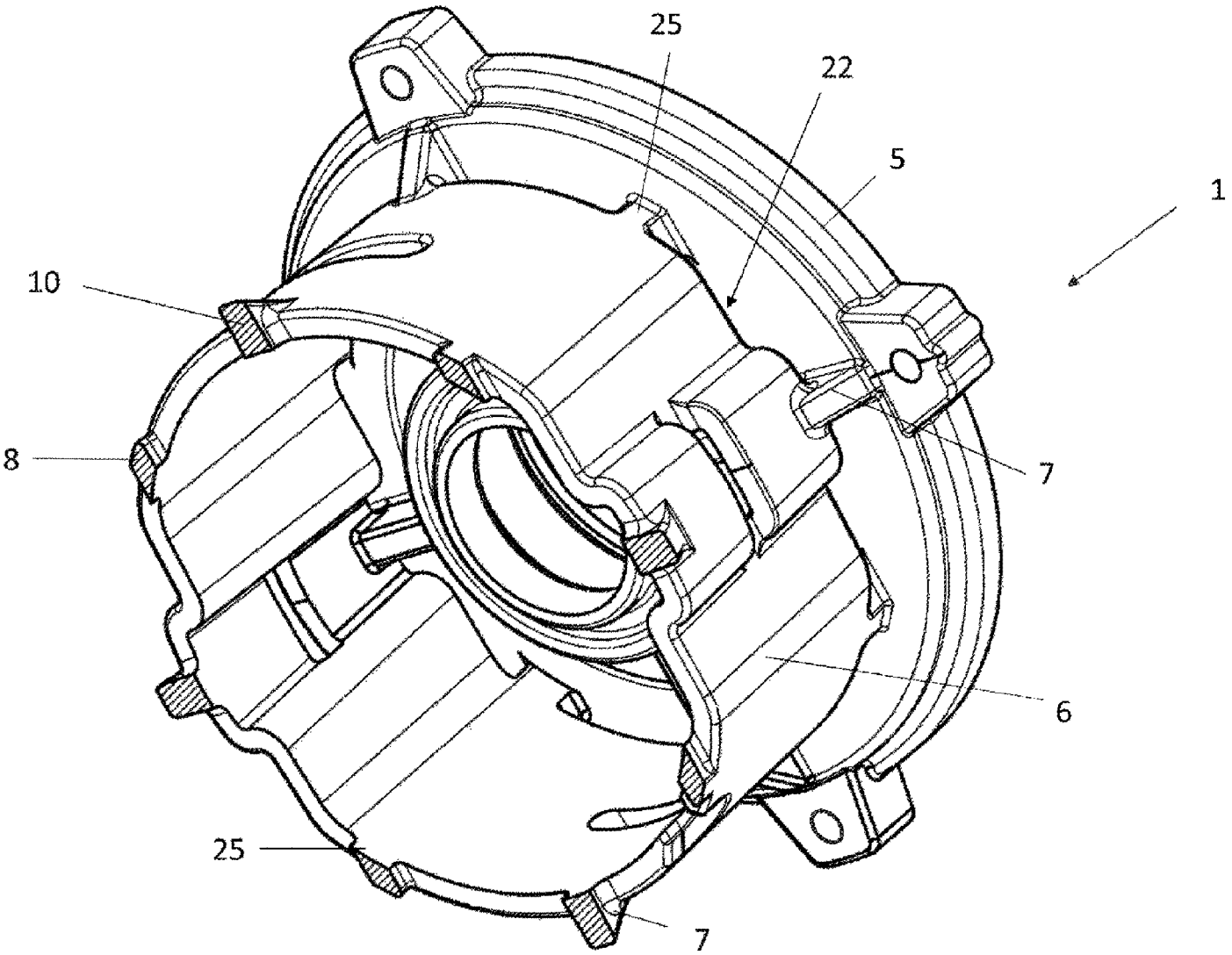
FIG. 3 shows a perspective illustration of a partial section of the coupling unit of FIG. 1.

FIG. 3 shows a perspective illustration of a partially sectioned coupling unit 1. The annular element 6 is in this variant suspended with four retention members 7 on the connection component 5 and additionally reinforced with four stabilization elements 25.

Figure 4:
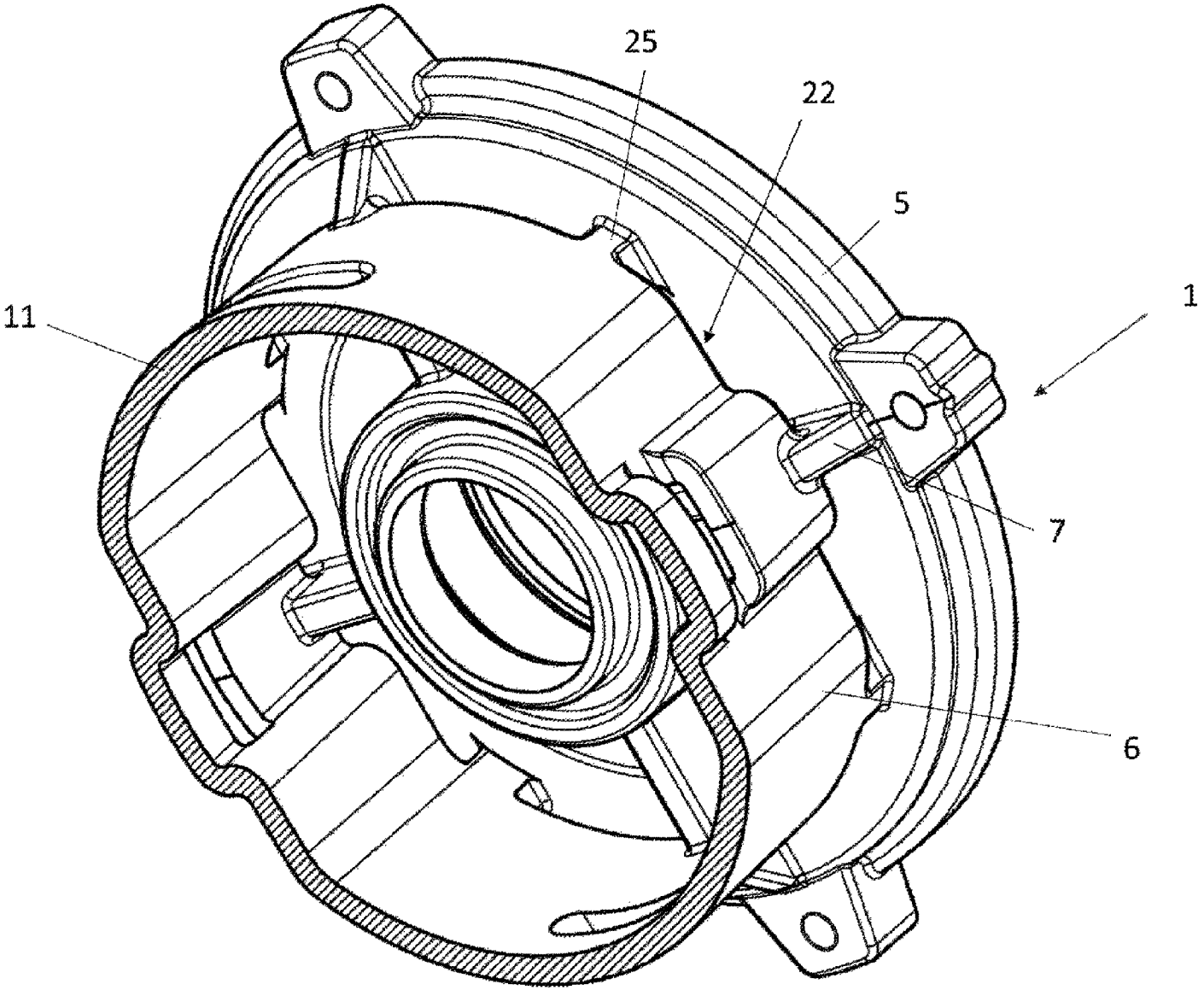
FIG. 4 shows a perspective illustration of another section through the coupling unit of FIG. 1.

FIG. 3 further shows a radial section in the connection region of the retention members 7 with the cross sectional surface-area 10 thereof and the cross sectional surface-area 8 of the stabilization elements 25. In this instance, the sum of the cross sectional surface-areas 8 and 10 is constructed to be more than 80% smaller than the cross sectional surface-area 11 of the annular element 6 in FIG. 4. A significant reduction of the thermal conduction from the pump housing 2 in the direction of the motor housing 3 is thereby achieved since the thermal conduction surface is constructed to be reduced to four minimal retention members 7 and four stabilization elements 25.

At the same time, at the side of the connection component 4 and at the side of the connection component 5 between the retention members 7 there are formed material recesses 22 in which the cooling air flow which is produced by the motor fan which is not illustrated can flow in order to discharge a heat flow. In addition, the cooling air flow discharges heat by flowing over the outer face of the coupling unit 1.

Figure 5:
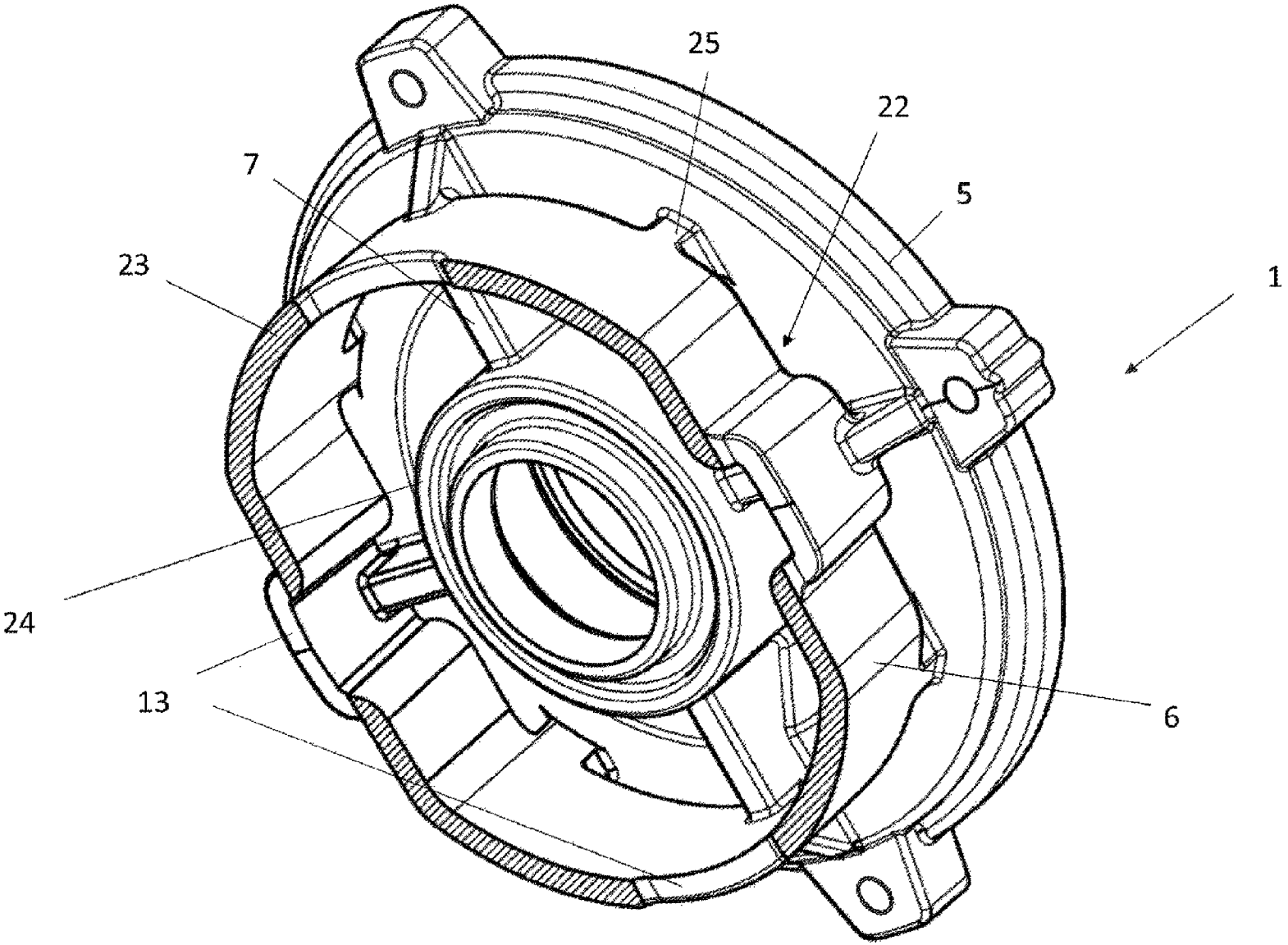
FIG. 5 shows a perspective illustration of a third section through the coupling unit of FIG. 1.

FIG. 5 shows a perspective illustration of a third section through the coupling unit 1 in which the aperture-like material recesses 13 of the annular element 6 are also sectioned. The cross sectional surface-area 23 is reduced by the aperture-like material recesses 13 in comparison with the cross sectional surface-area 11 of the annular element 6 in FIG. 4 by 40%, whereby the thermal conduction from the pump housing 2 in the direction toward the motor housing 3 is significantly reduced. At the same time, the cooling air flow of the motor fan can also flow through the aperture-like material recesses 13 and discharge heat.

The four strut-like retention members 7 extend from the edge of the connection component 5 as far as the cylindrical bearing sleeve 24, which serves to receive a radial bearing which is not illustrated. In this variant of the invention, the connection component 5 is configured integrally as a bearing carrier cover of the motor housing 3 and supports a radial bearing of the pump shaft 18. As a result of the continuation of the retention members 7 at the inner side of the annular element 6, the bearing sleeve 24 is advantageously reinforced and stiffened.

In addition to the four retention members 7, a further four stabilization elements 25 for suspending the annular element 6 are arranged between the annular element 6 and the connection component 5. In this instance, the stabilization elements 25 are arranged with a very small cross sectional surface-area in order to reduce the thermal conduction centrally between two retention members 7 in each case. Starting from the pump shaft 18 which is not illustrated, the four retention members 7 are arranged in each case to be offset through 90°, whilst the four stabilization elements 25 are also arranged to be offset through 90° with respect to each other, wherein the stabilization elements 25 are positioned to be offset through 45° with respect to the retention members 7.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A pump arrangement, comprising:

a coupling unit configured to connect a pump housing and a motor housing to one another, wherein the coupling unit has a pump-side connection component and a motor-side connection component, the coupling unit has an annular element suspended between the connection components by retention members having a connection region, and the retention members of the connection components extend radially inward to the annular element and a form a rigid suspension of the annular element, whereby a cross-sectional area of the retention members is reduced compared to a cross-sectional area of the annular element, to thereby reduce heat conduction.

2. The pump arrangement as claimed in claim 1, wherein the annular element is arranged radially inside a base face of at least one of the connection components.

3. The pump arrangement as claimed in claim 2, wherein the retention members are struts connecting the annular element to the base face of at least one of the connection components.

4. The pump arrangement as claimed in claim 3, wherein stabilization elements are arranged between the connection components and the annular element, and wherein at least one of the stabilization elements is arranged between two of the retention members.

5. The pump arrangement as claimed in claim 1, wherein cross sectional surface-areas of a radial section in the connection region of the retention members are more than 65% smaller than the cross sectional surface-area of end faces of the annular element.

6. The pump arrangement as claimed in claim 5, wherein the cross sectional surface-areas of the radial section in the connection region of the retention members are more than 85% smaller than the cross sectional surface-area of end faces of the annular element.

7. The pump arrangement as claimed in claim 6, wherein the annular element has at least one material recess in the form of an aperture.

8. The pump arrangement as claimed in claim 7, wherein the annular element has at least one reinforcement formation adjacent to at least one of the retention members.

9. The pump arrangement as claimed in claim 8, wherein the annular element is suspended at each end by three to eight of the retention members.

10. The pump arrangement as claimed in claim 9, wherein at each end of the annular element the number of stabilization elements corresponds to the number of retention members.

11. The pump arrangement as claimed in claim 1, wherein the coupling unit is configured to directly connect the pump housing and the motor housing.

12. The pump arrangement as claimed in claim 1, wherein the coupling unit has a shape which is one of a cylindrical shape, a funnel shape, a conical shape, a polygonal shape, or one or more thereof.

13. The pump arrangement as claimed in claim 1, wherein the pump-side connection component is constructed integrally with a motor-side pressure cover of the pump housing.

14. The pump arrangement as claimed in claim 1, wherein the motor-side connection component is constructed integrally with a pump-side motor cover of the motor housing.

15. A pump arrangement, comprising:

a coupling unit configured to connect a pump housing and a motor housing to one another, wherein the coupling unit has a pump-side connection component and a motor-side connection component, the coupling unit has an annular element suspended between the connection components by retention members having a connection region, and cross sectional surface-areas of a radial section in the connection region of the retention members are more than 65% smaller than a cross sectional surface-area of end faces of the annular element.

* * * * *